US006724280B2

(12) United States Patent
Shamsaifar et al.

(10) Patent No.: US 6,724,280 B2
(45) Date of Patent: Apr. 20, 2004

(54) TUNABLE RF DEVICES WITH METALLIZED NON-METALLIC BODIES

(75) Inventors: Khosro Shamsaifar, Ellicott City, MD (US); Alden Partridge, Columbia, MD (US); Edward Davis, Towson, MD (US); John Robinson, Mount Airy, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/097,319

(22) Filed: Mar. 14, 2002

(65) Prior Publication Data

US 2002/0140527 A1 Oct. 3, 2002

Related U.S. Application Data

(60) Provisional application No. 60/278,962, filed on Mar. 27, 2001.

(51) Int. Cl.[7] ..... H01P 1/207

(52) U.S. Cl. ..... 333/209; 333/211; 333/235

(58) Field of Search ..... 333/208–212, 333/202, 2.35, 2.31

(56) References Cited

U.S. PATENT DOCUMENTS

| | | | | |
|---|---|---|---|---|
| 3,955,161 A | * | 5/1976 | MacTurk | 333/209 |
| 3,969,814 A | | 7/1976 | Toy et al. | |
| 4,454,489 A | | 6/1984 | Donazzan et al. | |

(List continued on next page.)

FOREIGN PATENT DOCUMENTS

| | | |
|---|---|---|
| JP | 55 042408 A | 3/1980 |
| JP | 59 074704 A | 4/1984 |
| JP | 61 238104 A | 10/1986 |
| WO | WO 00/3.5042 A1 | 6/2000 |
| WO | WO 01/15260 A1 | 3/2001 |

OTHER PUBLICATIONS

U.S. patent application Ser. No. 09/834,327, Chang et al., filed Apr. 13, 2001.

U.S. patent application Ser. No. 09/838,483, Sengupta et al., filed Apr. 19, 2001.

U.S. patent application Ser. No. 09/882,605, Sengupta, filed Jun. 15, 2001.

U.S. patent application Ser. No. 60/295,046, Luna et al., filed Jun. 1, 2001.

U.S. patent application Ser. No. 09/419,126, Sengupta et al., filed Oct. 15, 1999.

U.S. patent application Ser. No. 09/594,837, Chiu, filed Jun. 15, 2000.

U.S. patent application Ser. No. 09/734,969, Zhu et al., filed Dec. 12, 2000.

U.S. patent application Ser. No. 09/768,690, Sengupta et al., filed Jan. 24, 2001.

PCT International Search Report for International Application No. PCT/US02/07850 dated Jul. 2, 2002.

V.N. Keis et al. "20 GHz Tunable Filter Based on Ferroelectric (Ba, Sr)$TiO_3$ Film Varactors", Electronic Letters, vol. 34, No. 11, pp. 1107–1109, May 28, 1998.

L.C. Sengupta et al. "Breakthrough Advances in Low Loss, Tunable Dielectric Materials", Materials Research Inovations, vol. 2, No. 5, pp. 278–282, Mar. 1999.

*Primary Examiner*—Robert Pascal
*Assistant Examiner*—Stephen E. Jones
(74) *Attorney, Agent, or Firm*—Robert P. Lenart; James S. Finn

(57) ABSTRACT

An electronic device comprises a non-metallic waveguide, a tunable component mounted within the waveguide, and a conductive layer on a surface of the waveguide. The tunable component can comprise a tunable filter. The non-metallic waveguide can comprise a plastic material. Connections for applying a tuning voltage to the tunable component can be provided. A temperature sensor can be connected to the waveguide.

15 Claims, 7 Drawing Sheets

U.S. PATENT DOCUMENTS 4,523,162 A 6/1985 Johnson
4,686,496 A 8/1987 Syrett et al.
4,761,625 A * 8/1988 Sharma ..... 333/209
5,312,790 A 5/1994 Sengupta et al.
5,355,104 A 10/1994 Wolfson et al.
5,363,464 A 11/1994 Way et al.
5,427,988 A 6/1995 Sengupta et al.
5,459,123 A 10/1995 Das ..... 505/210
5,486,491 A 1/1996 Sengupta et al.
5,515,682 A 5/1996 Nagakubo et al.
5,578,976 A 11/1996 Yao ..... 333/262
5,589,807 A 12/1996 Tang
5,635,433 A 6/1997 Sengupta
5,635,434 A 6/1997 Sengupta
5,693,429 A 12/1997 Sengupta et al.
5,714,791 A 2/1998 Chi et al.
5,766,697 A 6/1998 Sengupta et al.
5,830,591 A 11/1998 Sengupta et al.
5,846,893 A 12/1998 Sengupta et al.
6,074,971 A 6/2000 Chiu et al.
6,340,922 B1 1/2002 Rust
6,392,508 B1 * 5/2002 Damphousse et al. ..... 333/209

* cited by examiner

TUNABLE RF DEVICES WITH METALLIZED NON-METALLIC BODIES

CROSS REFERENCE TO RELATED APPLICATION

This application claims the benefit of U.S. Provisional Application No. 60/278,962, filed Mar. 27, 2001.

FIELD OF INVENTION

This invention relates to tunable, radio frequency, waveguide devices for use in broadband wireless, and other telecommunications applications.

BACKGROUND OF INVENTION

The use of broadband wireless communication systems has increased in the last decade, crowding the available radio frequency spectrum and creating a need for higher to rejection between adjacent channels. Higher rejection requires either more complex filters with higher loss and higher cost, or narrower bandwidth filters resulting in the need for more discreet filter designs to accommodate the full radio spectrum.

Radio manufacturers are forced to make trade-offs between performance requiring more complex designs or more inventory and lower cost requiring broader bandwidths and lower signal-to-noise ratios.

Electronically tunable filter designs are now possible through the advent tunable dielectric materials. These materials, that change dielectric properties through the application of a DC bias voltage, can be used in the resonator of a filter structure allowing the filter to be electronically tuned across broad frequency bands. This opens the possibility of replacing many narrow band, fixed frequency designs with a single tunable design, thereby reducing inventory and associated costs without sacrificing performance or increasing unit cost. Examples of filters including tunable dielectric materials are shown in U.S. patent application Ser. No. 09/734,969 (International Publication No. WO 00/35042 A1), the disclosure of which is hereby incorporated by reference.

Tunable dielectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BSTO) or BSTO composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO-MgO"; U.S. Pat. No. 5,486,491 to Sengupta, et al. entitled "Ceramic Ferroelectric Composite Material-BSTO-$ZrO_2$"; U.S. Pat. No. 5,635,434 to Sengupta, et al. entitled "Ceramic Ferroelectric Composite Material-BSTO-Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; U.S. Pat. No. 5,635,433 to Sengupta, entitled "Ceramic Ferroelectric Composite Material-BSTO-ZnO"; and U.S. Pat. No. 6,074,971 by Chiu et al. entitled "Ceramic Ferroelectric Composite Materials with Enhanced Electronic Properties BSTO-Mg Based Compound-Rare Earth Oxide". These patents are hereby incorporated by reference. The materials shown in these patents, especially BSTO-MgO composites, show low dielectric loss and high tunability. Tunability is defined as the fractional change in the dielectric constant with applied voltage.

In addition, the following U.S. Patent Applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases" (International Publication No. WO 01/96258 A1); U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same" (International Publication No. WO 01/99224 A1); U.S. application Ser. No. 09/834,327 filed Apr. 13, 2001, entitled "Strain-Relieved Tunable Dielectric Thin Films"; and U.S. Provisional Application Serial No. 60/295,046 filed Jun. 1, 2001 entitled "Tunable Dielectric Compositions Including Low Loss Glass Frits". These patent applications are incorporated herein by reference.

U.S. patent application Ser. No. 09/838,483 (International Publication No. WO 01/82404 A1) discloses a waveguide-finline tunable phase shifter and is hereby incorporated by reference.

For maximum performance over broad operating temperature ranges the temperature of a radio frequency component using electronically tuned material must be controlled by passive temperature compensation and/or active thermal control. Active thermal control requires either injection or extraction of heat, which may be highly inefficient unless proper precautions are taken to isolate the filter from the thermal environment.

There is a need for tunable electronic devices that can operate in a variable temperature environment, while maintaining satisfactory electronic operation.

SUMMARY OF THE INVENTION

Electronic devices constructed in accordance with this invention include a non-metallic waveguide, a tunable component mounted within the waveguide, and a conductive layer on a surface of the waveguide. The tunable component can comprise a tunable filter. The non-metallic waveguide can comprise a plastic material. Connections for applying a tuning voltage to the tunable component can be provided. The conductive layer can comprise a metal. A temperature sensor can be connected to the waveguide to provide a signal representative of the temperature of the device. That signal can be used to control an associated temperature control unit.

DETAILED DESCRIPTION OF THE INVENTION

Figure 1:
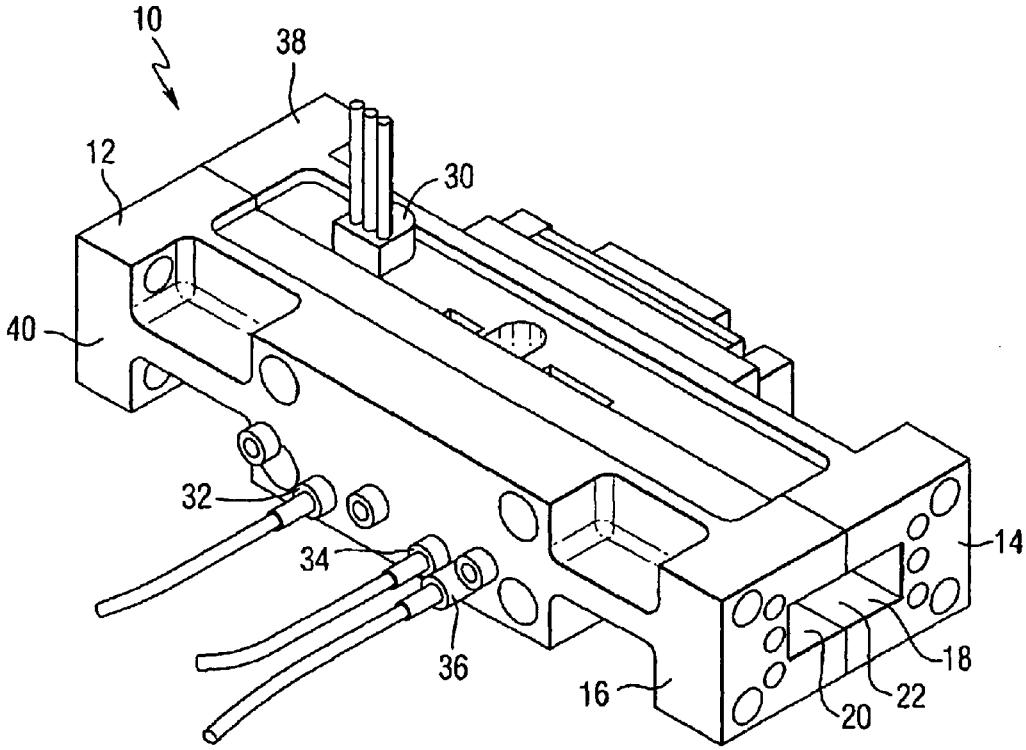
FIG. 1 is an isometric view of an electronic device constructed in accordance with one embodiment of the invention.
Figure 2:
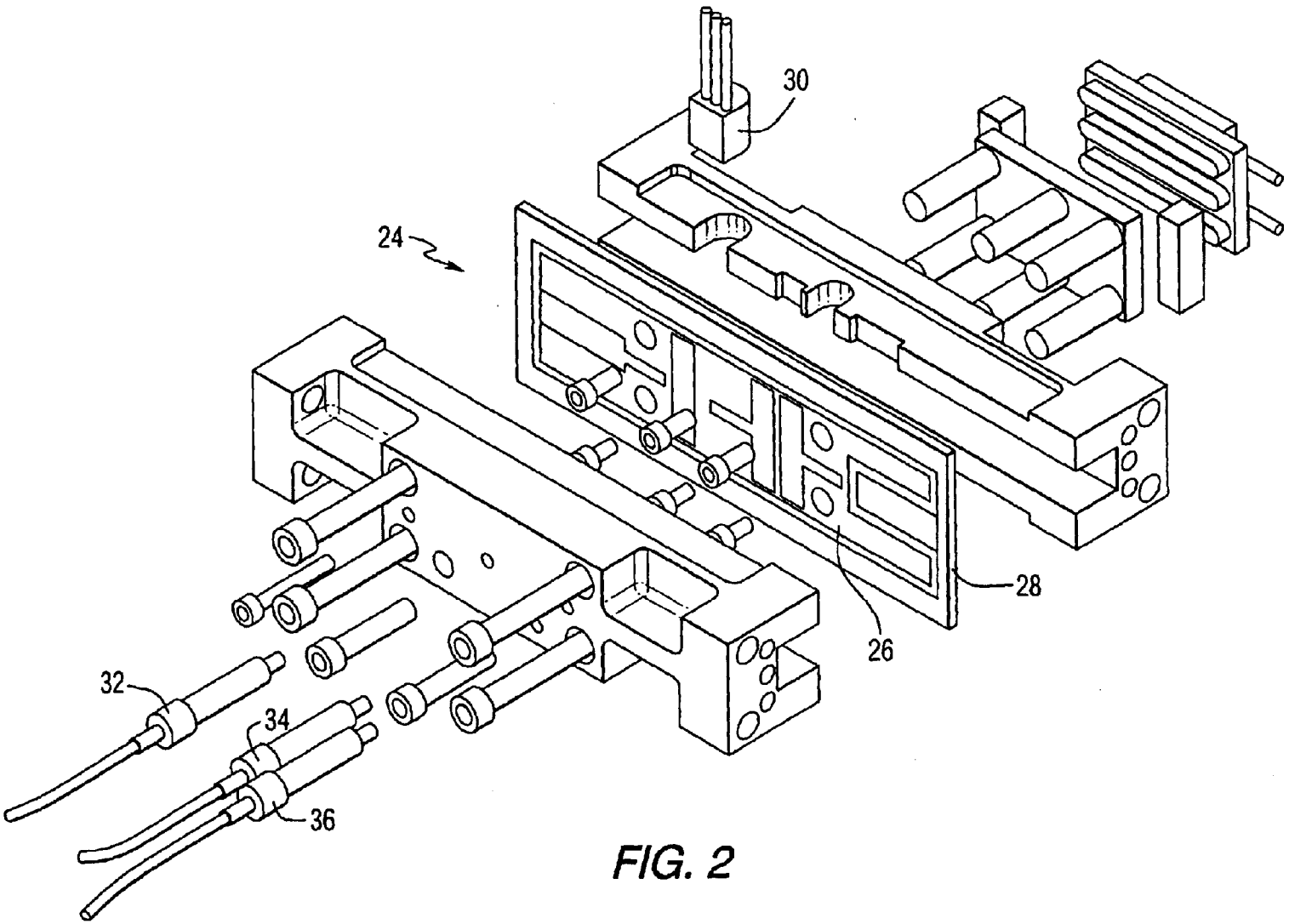
FIG. 2 is an exploded view of the device of FIG. 1.

Referring to the drawings, FIG. 1 is an isometric view of an electronic device constructed in accordance with one embodiment of the invention, and FIG. 2 is an exploded view of the device of FIG. 1. In FIGS. 1 and 2, the filter assembly 10 includes a waveguide 12 comprising sections 14 and 16. Each waveguide section defines a longitudinal groove 18 and 20. The grooves are aligned such that when the waveguide sections are brought together, the grooves form a channel 22. A tunable component 24 is mounted within the channel. The tunable component in this embodiment is a tunable filter having a tunable dielectric material 26 mounted on a septum 28. The tunable dielectric material is used to form various elements of the filter, such as varactors, for example as shown in U.S. patent application Ser. No. 09/419,126 (International Publication No. WO 00/24079 A1), the disclosure of which is hereby incorporated by reference.

The tunable component in this embodiment is a tunable filter described by the septum 28. In the embodiment depicted in FIGS. 1 and 2, a three pole filter is shown. Each pole or resonator is represented by a horizontal slot with narrow height. The varactors are mounted near the end of the resonators as shown. The filter is formed by the slots as depicted in FIG. 2. The septum 28 that carries the tunable varactors is sandwiched between the two waveguide sections. In one embodiment, the waveguide sections are comprised of a metallized plastic material, such as cross-linked polystrene (Rexolite) or acrylonitrile butadiene styrene (ABS), with low thermal conductivity, with a layer of conductive material deposited on the surface of the plastic. A temperature sensor 30 is mounted on the waveguide and supplies feedback to a controller shown in FIG. 3, to compensate for frequency drift. Connecting Pins 32, 34 and 36 are used to bias the varactors.

In addition to poor thermal conduction properties, the plastic also has poor electrical conductivity and therefore will not guide electromagnetic energy unless it is coated with a conductive material. In the preferred embodiment, the conductive material comprises a layer 38, 40 of a high conductivity metal such as copper, silver or gold. The thickness of the conductive layer will depend upon the skin depth at the frequencies of interest.

Figure 3:
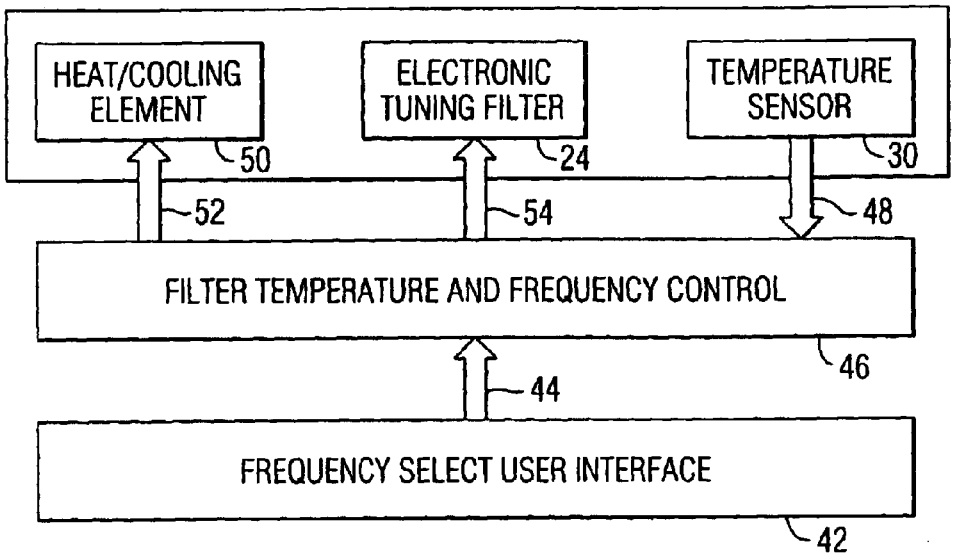
FIG. 3 is a functional block diagram of a filter controller that includes devices constructed in accordance with the invention.

FIG. 3 is a functional block diagram of filter control system that includes devices constructed in accordance with the invention. The control system includes a frequency select user interface 42, which provides control signals on bus 44 to a filter temperature and frequency control 46. For active control, the filter temperature and frequency control 46 receives a signal representative of the temperature of the device on bus 48 and provides a control signal to a heating/cooling element 50 on bus 52. The heating/cooling device can be a resistive heating element for heating only, or a Peltier element for heating and cooling.

Bus 54 is used to supply bias voltage to the tunable dielectric material to control the dielectric constant thereof. The invention also encompasses passively controlled systems where the filter temperature and frequency control 46 receives a signal representative of the temperature of the device on bus 48 and provides a supply voltage to the tunable dielectric material, without the use of a heating/cooling element. In both active and passive systems, the voltage supplied to the tunable material can be controlled in response to both the desired frequency set by the user and the temperature of the device. For example, the control can use a lookup table to find the correct control voltage for a particular set of desired frequency and temperature parameters.

Figure 4:
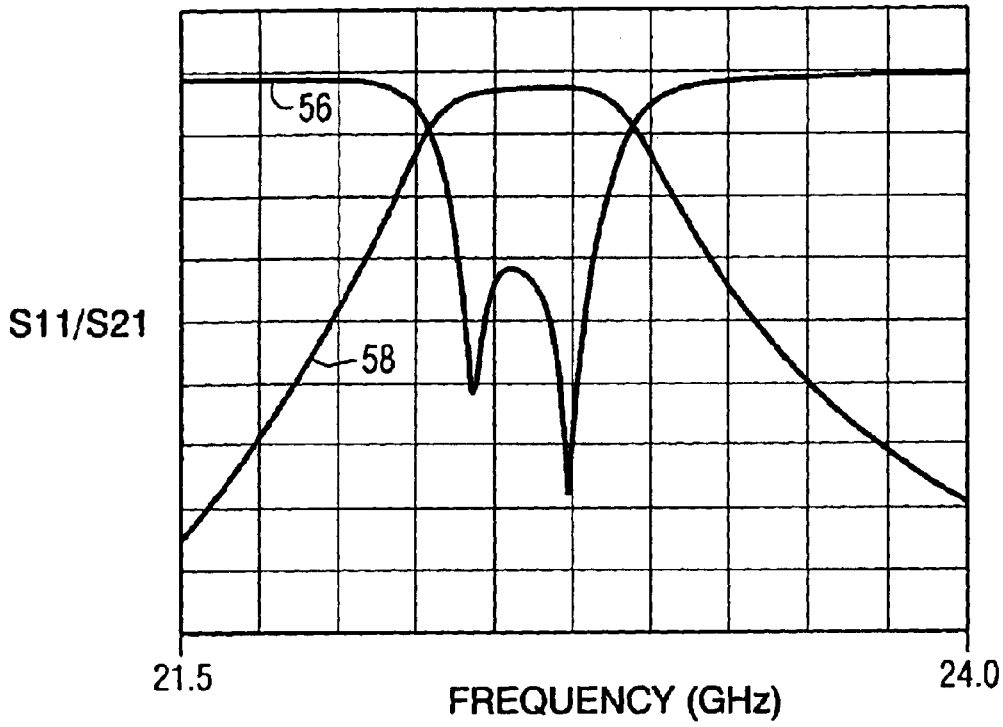
FIGS. 4 and 5 are graphs of the response of a filter constructed in accordance with the invention.
Figure 5:
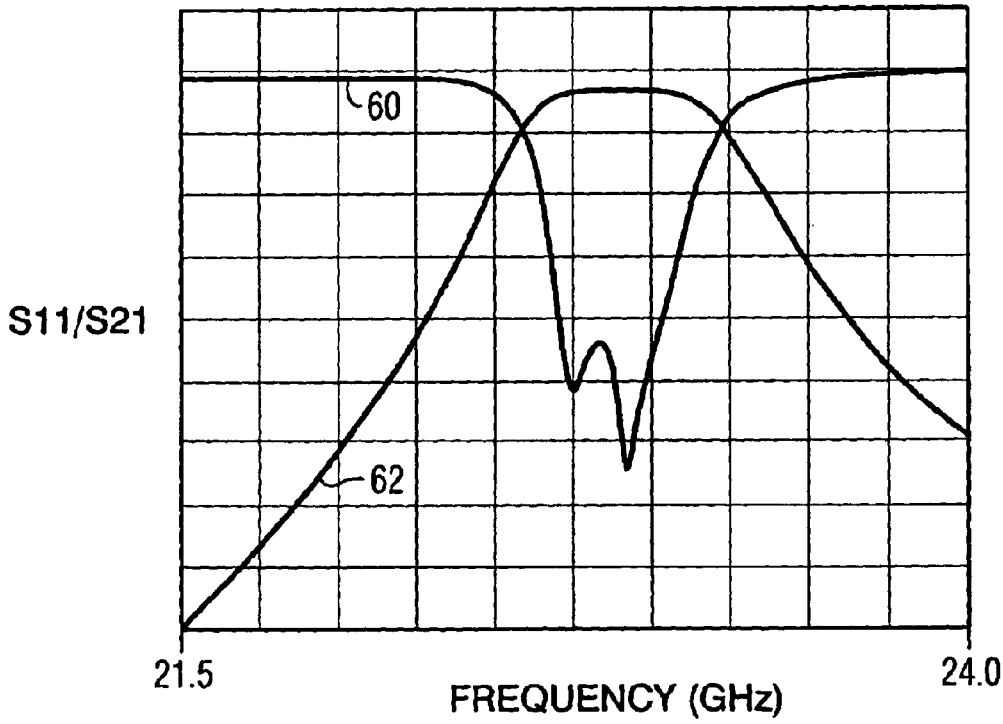

Typical performance of a tunable K-band filter with plastic body is illustrated in FIGS. 4 and 5. FIG. 4 shows the insertion loss 56 and return loss 58 of the filter when tuned to its low frequency setting. FIG. 5 shows the insertion loss 60 and return loss 62 of the same filter electronically tuned to a higher frequency setting.

Figure 6:
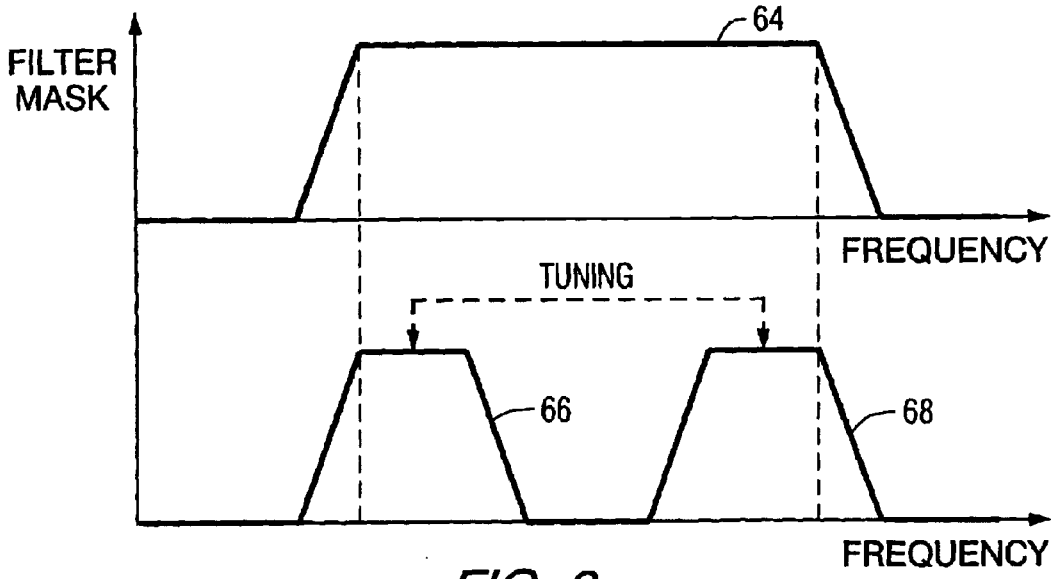
FIG. 6 is a graph of typical filter pass bands for tunable and non-tunable filters.

FIG. 6 illustrates a typical pass band 64 of a fixed frequency K-band filter, and a pass band 66, 68 of a tunable filter covering the same effective bandwidth. Two observations may be made. First the tunable filter allows significantly less adjacent channel traffic through at any particular frequency setting by virtue of its reduced bandwidth. This adjacent channel traffic could otherwise cause interference. Second, when used in a diplexer configuration, the tunable filter has better isolation against the duplex frequency by virtue of its larger guard band.

Figure 7:
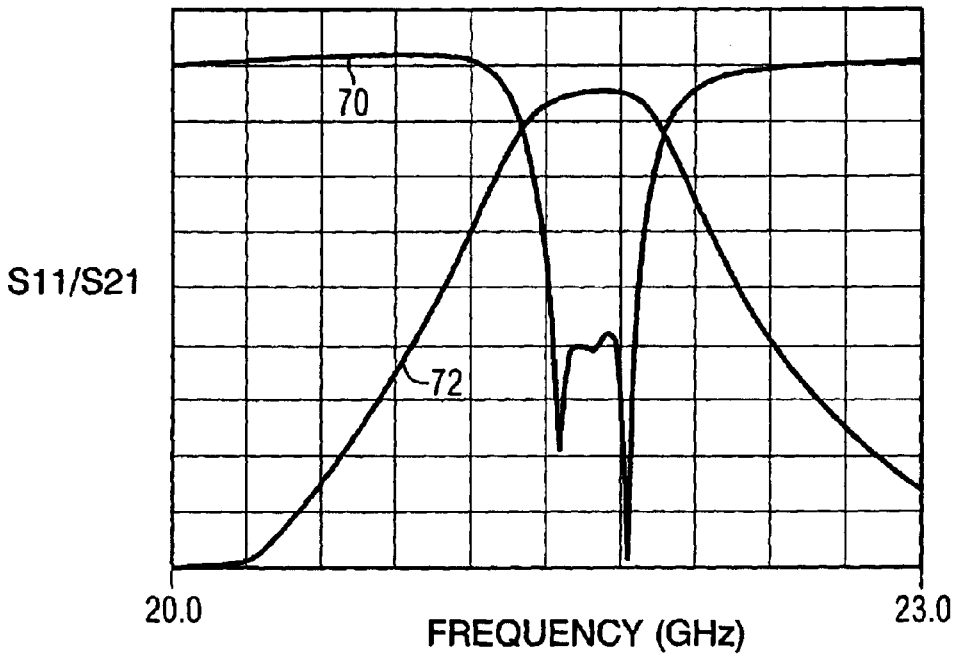
FIGS. 7 and 8 are graphs of the response of a metallic housing filter and a filter constructed in accordance with the invention.
Figure 8:
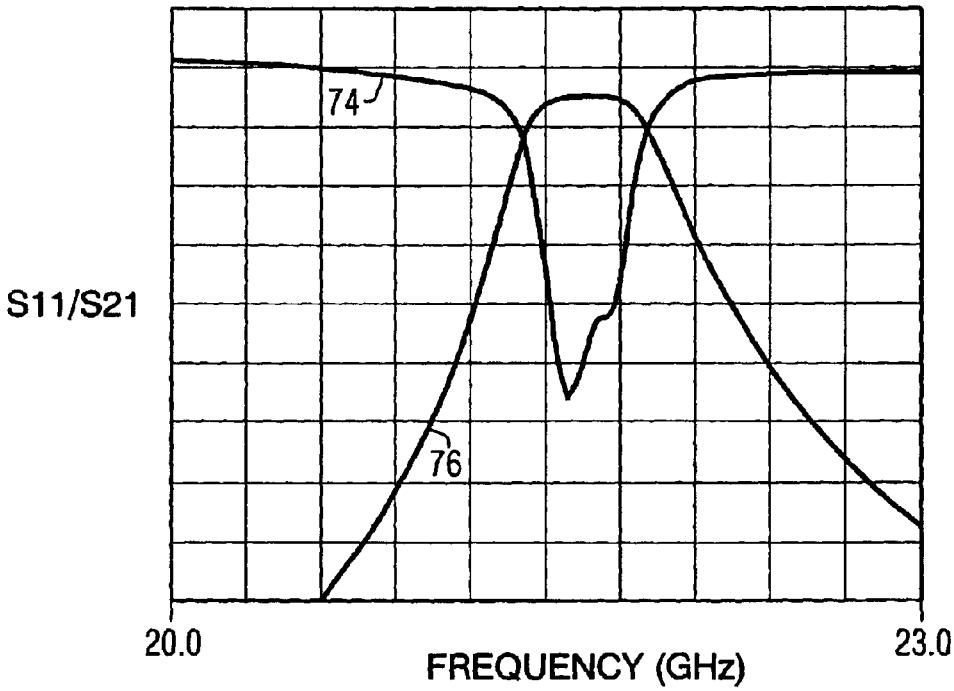

FIG. 7 is a plot of typical insertion loss 70 and return loss 72 values for a metal filter body. FIG. 8 is a plot of typical insertion loss 74 and return loss 76 values for a plastic filter body. The power required to maintain a 10° C. temperature difference from the ambient temperature was measured for both a metal body and a plastic body. The metal body required approximately 4 watts and the plastic body required only 2 watts.

As used herein, the term "tunable dielectric material" means a material that exhibits a variable dielectric constant upon the application of a variable voltage. The tunability may be defined as the dielectric constant of the material with an applied voltage divided by the dielectric constant of the material with no applied voltage. Thus, the voltage tunability percentage may be defined by the formula:

$$T=((X-Y)/X)\cdot 100;$$

where X is the dielectric constant with no voltage and Y is the dielectric constant with a specific applied voltage. High tunability is desirable for many applications. For example, in the case of waveguide-based devices, the higher tunability will allow for shorter electrical length, which means a lower insertion loss can be achieved in the overall device. The preferred voltage tunable dielectric materials preferably exhibit a tunability of at least about 20 percent at an applied electric field of 8V/micron, more preferably at least about 25 percent at 8V/micron. For example, the voltage tunable dielectric material may exhibit a tunability of from about 30 to about 75 percent or higher at 8V/micron.

The combination of tunable dielectric materials such as BSTO with additional metal oxides allows the materials to have high tunability, low insertion losses and tailorable dielectric properties, such that they can be used in microwave frequency applications. The materials demonstrate improved properties such as increased tuning, reduced loss tangents, reasonable dielectric constants for many microwave applications, stable voltage fatigue properties, higher breakdown levels than previous state of the art materials, and improved sintering characteristics. A particular advantage of materials such as BSTO with additional metal oxides is that tuning is dramatically increased compared with conventional low loss tunable dielectrics. The tunability and stability achieved with these materials enables new RF applications not previously possible. A further advantage is that the materials may be used at room temperature. The electronically tunable materials may be provided in several manufacturable forms such as bulk ceramics, thick film dielectrics and thin film dielectrics.

Figure 9:
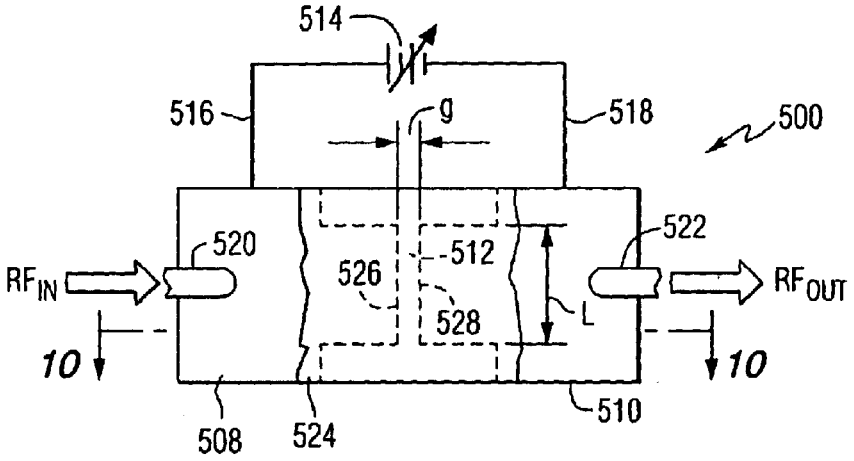
FIG. 9 is a top plan view of a voltage tunable dielectric varactor that can be used in the filters of the present invention.
Figure 10:
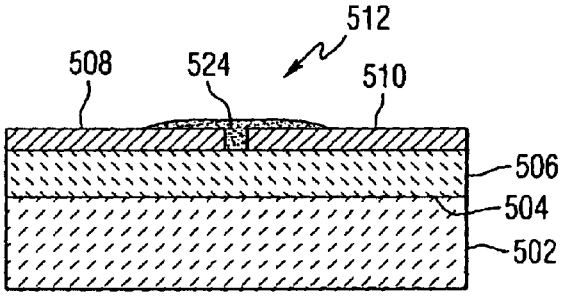
FIG. 10 is a cross sectional view of the varactor of FIG. 9, taken along line 10—10.

FIGS. 9 and 10 are top and cross sectional views of a voltage tunable dielectric varactor 500 that can be used in filters constructed in accordance with this invention. The varactor 500 includes a substrate 502 having a generally planar top surface 504. A tunable ferroelectric layer 506 is positioned adjacent to the top surface of the substrate. A pair of metal electrodes 508 and 510 are positioned on top of the ferroelectric layer. The substrate 502 is comprised of a material having a relatively low permittivity such as MgO, Alumina, $LaAlO_3$, Sapphire, or a ceramic. For the purposes of this description, a low permittivity is a permittivity of less than about 30. The tunable ferroelectric layer 506 is comprised of a material having a permittivity in a range from about 20 to about 2000, and having a tunability in the range from about 10% to about 80% when biased by an electric field of about 10 V/$\mu$m. The tunable dielectric layer can be comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO-MgO, BSTO-$MgAl_2O_4$, BSTO-$CaTiO_3$, BSTO-$MgTiO_3$, BSTO-$MgSrZrTiO_6$, and combinations thereof. The tunable layer can have a dielectric permittivity greater than 100 when subjected to typical DC bias voltages, for example, voltages ranging from about 5 volts to about 300 volts. A gap 528 of width g, is formed between the electrodes 508 and 510. The gap width can be optimized to increase the ratio of the maximum capacitance $C_{max}$ to the minimum capacitance $C_{min}$ ($C_{max}/C_{min}$) and increase the quality factor (Q) of the device. The optimal width, g, is the width at which the device has maximum $C_{max}/C_{min}$ and minimal loss tangent. The width of the gap can range from 5 to 50 $\mu$m depending on the performance requirements.

A controllable voltage source 514 is connected by lines 516 and 518 to electrodes 508 and 510. This voltage source is used to supply a DC bias voltage to the ferroelectric layer, thereby controlling the permittivity of the layer. The varactor also includes an RF input 520 and an RF output 522. The RF input and output are connected to electrodes 18 and 20, respectively, such as by soldered or bonded connections.

In typical embodiments, the varactors may use gap widths of less than 50 $\mu$m, and the thickness of the ferroelectric layer can range from about 0.1 $\mu$m to about 20 $\mu$m. A sealant 524 can be positioned within the gap and can be any non-conducting material with a high dielectric breakdown strength to allow the application of a high bias voltage without arcing across the gap. Examples of the sealant include epoxy and polyurethane.

The length of the gap L can be adjusted by changing the length of the ends 526 and 528 of the electrodes. Variations in the length have a strong effect on the capacitance of the varactor. The gap length can be optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$ ratio. The optimum thickness of the ferroelectric layer is the thickness at which the maximum $C_{max}/C_{min}$ occurs. The ferroelectric layer of the varactor of FIGS. 9 and 10 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.001 to about 0.005. For operation at frequencies ranging from about 10 GHz to about 20 GHz, the loss tangent would range from about 0.005 to about 0.01. For operation at frequencies ranging from about 20 GHz to about 30 GHz, the loss tangent would range from about 0.01 to about 0.02.

The electrodes may be fabricated in any geometry or shape containing a gap of predetermined width. The required current for manipulation of the capacitance of the varactors disclosed in this invention is typically less than 1 $\mu$A. In one example, the electrode material is gold. However, other conductors such as copper, silver or aluminum, may also be used. Gold is resistant to corrosion and can be readily bonded to the RF input and output. Copper provides high conductivity, and would typically be coated with gold for bonding or with nickel for soldering.

Figure 11:
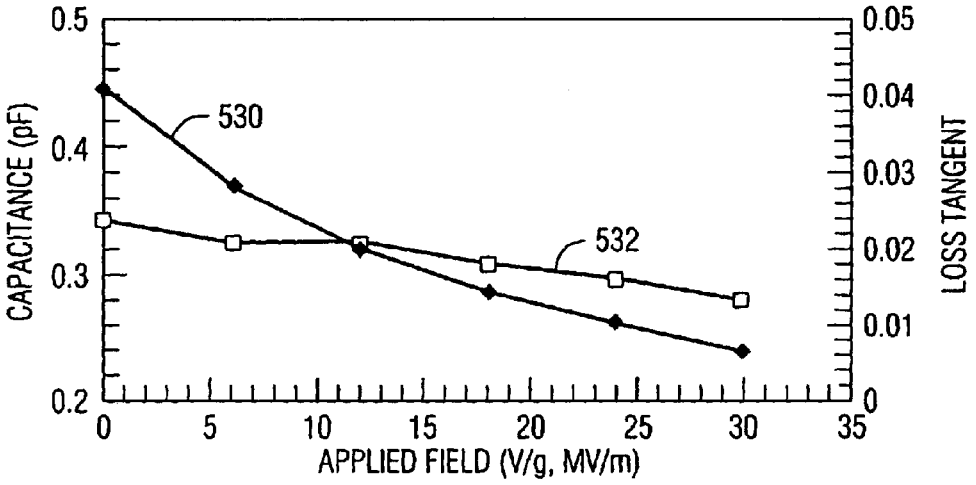
FIG. 11 is a graph that illustrates the properties of the dielectric varactor of FIG. 9.

Voltage tunable dielectric varactors as shown in FIGS. 9 and 10 can have Q factors ranging from about 50 to about 1,000 when operated at frequencies ranging from about 1 GHz to about 40 GHz. The typical Q factor of the dielectric varactor is about 1000 to 200 at 1 GHz to 10 GHz, 200 to 100 at 10 GHz to 20 GHz, and 100 to 50 at 20 to 30 GHz. $C_{max}/C_{min}$ is about 2, which is generally independent of frequency. The capacitance (in pF) and the loss factor (tan $\delta$) of a varactor measured at 20 GHz for gap distance of 10 $\mu$m at 300° K is shown in FIG. 11. Line 530 represents the capacitance and line 532 represents the loss tangent.

Figure 12:
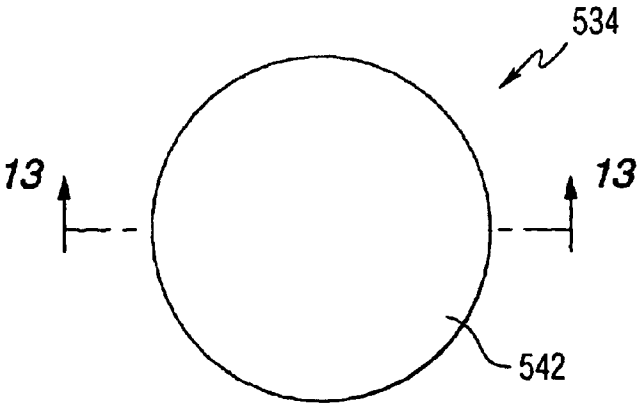
FIG. 12 is a top plan view of another voltage tunable dielectric varactor that can be used in the filters of the present invention.
Figure 13:
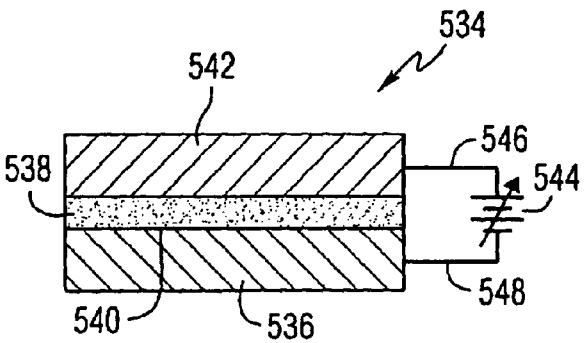
FIG. 13 is a cross sectional view of the varactor of FIG. 12, taken along line 13—13.

FIG. 12 is a top plan view of a voltage controlled tunable dielectric capacitor 534 that can be used in the filters of this invention. FIG. 13 is a cross sectional view of the capacitor 534 of FIG. 12 taken along line 13—13. The capacitor includes a first electrode 536, a layer, or film, of tunable dielectric material 538 positioned on a surface 540 of the first electrode, and a second electrode 542 positioned on a side of the tunable dielectric material 538 opposite from the first electrode. The first and second electrodes are preferably metal films or plates. An external voltage source 544 is used to apply a tuning voltage to the electrodes, via lines 546 and 548. This subjects the tunable material between the first and second electrodes to an electric field. This electric field is used to control the dielectric constant of the tunable dielectric material. Thus the capacitance of the tunable dielectric capacitor can be changed.

Figure 14:
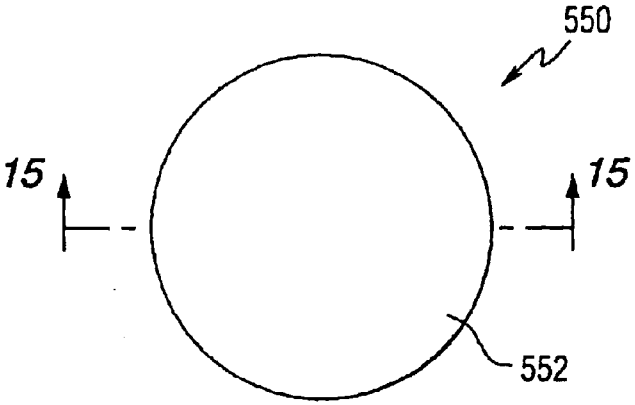
FIG. 14 is a top plan view of another voltage tunable dielectric varactor that can be used in the filters of the present invention.
Figure 15:
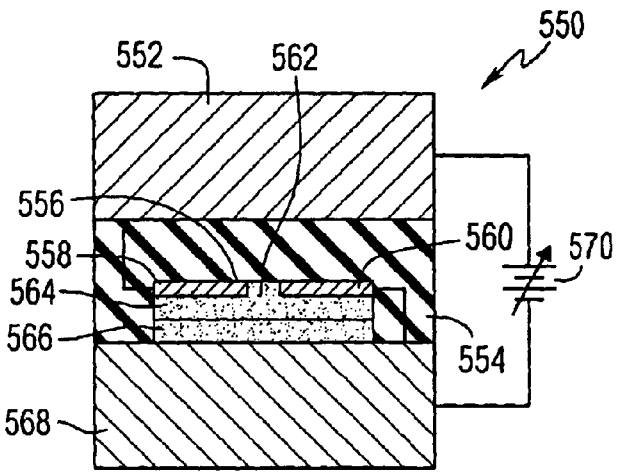
FIG. 15 is a cross sectional view of the varactor of FIG. 14, taken along line 15—15.

FIG. 14 is a top plan view of another voltage controlled tunable dielectric capacitor 550 that can be used in the filters of this invention. FIG. 15 is a cross sectional view of the capacitor of FIG. 14 taken along line 15—15. The tunable dielectric capacitor of FIGS. 14 and 15 includes a top conductive plate 552, a low loss insulating material 554, a bias metal film 556 forming two electrodes 558 and 560 separated by a gap 562, a layer of tunable material 564, a low loss substrate 566, and a bottom conductive plate 568. The substrate 566 can be, for example, MgO, $LaAlO_3$, alumina, sapphire or other materials. The insulating material can be, for example, silicon oxide or a benzocyclobutene-based polymer dielectric. An external voltage source 570 is used to apply voltage to the tunable material between the first and second electrodes to control the dielectric constant of the tunable material.

The tunable dielectric film of the tunable capacitors can be Barium-Strontium Titanate, $Ba_xSr_{1-x}TiO_3$ (BSTO) where $0<x<1$, BSTO-oxide composite, or other voltage tunable materials. Between electrodes 508 and 510, the gap 524 has a width g, known as the gap distance. This distance g must be optimized to have a higher $C_{max}/C_{min}$ ratio in order to reduce bias voltage, and increase the Q of the tunable dielectric capacitor. The typical g value is about 10 to 30 $\mu$m. The thickness of the tunable dielectric layer affects the ratio $C_{max}/C_{min}$ and Q. For tunable dielectric capacitors, parameters of the structure can be chosen to have a desired trade off among Q, capacitance ratio, and zero bias capacitance of the tunable dielectric capacitor. The typical Q factor of the tunable dielectric capacitor is about 200 to 500 at 1 GHz, and 50 to 100 at 20 to 30 GHz. The $C_{max}/C_{min}$ ratio is 2, which is independent of frequency.

A wide range of capacitance of the tunable dielectric capacitors is available, for example 0.1 pF to 10 pF. The tuning speed of the tunable dielectric capacitors is typically about 30 ns. The voltage bias circuits, which can include radio frequency isolation components such as a series inductance, determine practical tuning speed. The tunable dielectric capacitor is a packaged two-port component, in which tunable dielectric can be voltage-controlled. The tunable film can be deposited on a substrate, such as MgO, $LaAlO_3$, sapphire, $Al_2O_3$ and other dielectric substrates. An applied voltage produces an electric field across the tunable dielectric, which produces an overall change in the capacitance of the tunable dielectric capacitor.

Tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Barium strontium titanate is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and combinations thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$, and combinations thereof. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $La_2O_3$, $MgNb_2O_6$, $SrNb_2O_6$, $BaNb_2O_6$, $MgTa_2O_6$, $BaTa_2O_6$ and $Ta_2O_3$, and combinations thereof.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$, and combinations thereof. These compositions can be BSTO and one of these components, or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one example, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In another example, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

Compared to semiconductor varactor based tunable filters, tunable dielectric capacitor based tunable filters have the merits of higher Q, lower loss, higher power-handling, and higher IP3, especially at higher frequencies (>10 GHz).

The tunable capacitors with microelectromachanical (MEM) technology can also be used in the tunable devices of this invention. At least two varactor topologies can be used, parallel plate and interdigital. In a parallel plate structure, one of the plates is suspended at a distance from the other plate by suspension springs. This distance can vary in response to an electrostatic force between two parallel plates induced by an applied bias voltage. In the interdigital configuration, the effective area of the capacitor is varied by moving the fingers comprising the capacitor in and out, thereby changing its capacitance value. MEM varactors have lower Q than their dielectric counterpart, especially at higher frequencies, but can be used in low frequency applications.

The waveguide housings that have been previously fabricated from high conductivity metallic materials to realize low insertion loss and good RF shielding are in the preferred embodiment of this invention, made of low cost plastic that is plated with metals. This invention reduces cost, reduces weight and improves thermal isolation of the filter from the environment.

This invention isolates tunable electronic devices such as electronic filters from the thermal environment, allowing active thermal equipment to efficiently inject or extract heat from the filter as required while reducing weight and cost. The isolation is provided by using metallized non-metallic materials to construct a waveguide body that houses the tunable device. In the preferred embodiment, the non-metallic waveguide comprises plastic materials, such as Rexolite or ABS, with low thermal conductivity. In the case of cold environments, heat can be applied to tunable material in the electronic device through the use of a resistive heater or a Peltier element. The low thermal conductivity of the non-metallic material reduces heat loss from the tunable device to the environment. In the case of hot environments, heat is extracted by a Peltier or similar element, and the non-metallic material reduces heat flow from the environment to the tunable device.

This invention provides a novel approach for reducing the cost of broadband, wireless, telecommunications radios, that improves filter performance by improving the signal-to-noise ratio through better rejection of adjacent channels. Reduction of the instantaneous bandwidth of the filter significantly reduces unwanted interference from adjacent channels. Tunability of the filter provides total frequency coverage. Passive temperature compensation through voltage control and active thermal control by heating or cooling reduce the temperature dependence of the filter's performance. Thermal isolation of the filter through the use of plastic waveguide bodies drastically improves the efficiency of the active thermal control. Filter performance equal to that of metal bodies is possible by coating the plastic bodies with metal plating.

This invention allows temperature invariant filter performance with high efficiency, results in substantially improved radio performance and lower cost, allows lower cost manufacturing methods such as injection molding, and allows significant weight reduction.

While the present invention has been described in terms of its preferred embodiments, those skilled in the art will recognize that various changes can be made to the disclosed embodiments without departing from the scope of the invention that is defined by the following claims. For example, the tunable component can comprise a filter having inductive irises in a rectangular waveguide, a dielectric resonator filter, or various other electronically tunable devices.

What is claimed is:

1. An electronic device comprising:

a non-metallic waveguide;

a tunable filter mounted within the waveguide, said tunable filter including a tunable capacitor and wherein said tunable capacitor comprises a layer of tunable dielectric material;

said tunable dielectric material operable at least at temperatures that include room temperature and wherein the dielectric constant can be changed by 10% to 80% at 10 V/$\mu$m; and a conductive layer on a surface of the waveguide.

2. The device of claim 1, wherein the tunable capacitor comprises: a microelectromechanical capacitor.

3. The device of claim 1, wherein the conductive layer comprises a material selected from the group consisting of: copper, silver and gold.

4. The device of claim 1, wherein the non-metallic waveguide comprises: a plastic material.

5. The device of claim 1, further comprising connecting pins for applying a tuning voltage to the tunable component.

6. The device of claim 1, further comprising:

a temperature sensor for sensing temperature in the waveguide.

7. The device of claim 1, wherein the tunable component comprises a septum; and said tunable dielectric material mounted on the septum.

8. The device of claim 1, wherein the layer of tunable dielectric material comprises:

barium strontium titanate or a composite of barium strontium titanate.

9. The device of claim 1, wherein the tunable capacitor comprises:

first and second electrodes positioned adjacent to the layer of tunable dielectric material.

10. The device of claim 9, wherein the layer of tunable dielectric material further comprises a non-tunable component.

11. The device of claim 9, wherein the layer of tunable dielectric material comprises a material selected from the group consisting of:

BaxSr1-xTiO3, BaxCa1-xTiO3, PbxZr1-xTiO3, PbxZr1-xSrTiO3, KTaxNb1-xO3, lead lanthanum zirconium titanate, PbTiO3, BaCaZrTiO3, NaNO3, KNbO3, LiNbO3, LiTaO3, PbNb2O6, PbTa2O6, KSr(NbO3) and NaBa2(NbO3)5KH2PO4, and combinations thereof.

12. The device of claim 11, wherein the layer of tunable dielectric material further comprises a material selected from the group consisting of:

MgO, MgTiO3, MgZrO3, MgSrZrTiO6, Mg2SiO4, CaSiO3, MgAl2O4, CaTiO3, Al2O3, SiO2, BaSiO3 and SrSiO3, and combinations thereof.

13. The device of claim 11, wherein the layer of tunable dielectric material further comprises a material selected from the group consisting of:

CaZrO3, BaZrO3, SrZrO3, BaSnO3, CaSnO3, MgSnO3, Bi2O3/2SnO2, Nd2O3, Pr7O11, Yb2O3, Ho2O3, La2O3, MgNb2O6, SrNb2O6, BaNb2O6, MgTa2O6, BaTa2O6 and Ta2O3, and combinations thereof.

14. The device of claim 11, wherein the layer of tunable dielectric material further comprises at least one metal silicate phase.

15. The device of claim 11, wherein the layer of tunable dielectric material further comprises at least two metal oxide phases.

* * * * *